US006659787B2

(12) United States Patent
Hayashi

(10) Patent No.: US 6,659,787 B2
(45) Date of Patent: Dec. 9, 2003

(54) ATTACHMENT PORTION STRUCTURE OF CONNECTOR

(75) Inventor: Hiroyuki Hayashi, Nagoya (JP)

(73) Assignees: Autonetworks Technologies, Ltd., Nagoya (JP); Sumitomo Electric Industries, Ltd., Osaka (JP); Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/987,728

(22) Filed: Nov. 15, 2001

(65) Prior Publication Data

US 2002/0064755 A1 May 30, 2002

(30) Foreign Application Priority Data

Nov. 24, 2000 (JP) ..... 2000-357216

(51) Int. Cl.[7] ..... H01R 13/64
(52) U.S. Cl. ..... 439/248; 439/247
(58) Field of Search ..... 439/247, 559, 439/560, 277, 588, 248, 92, 607, 63, 94, 852, 498, 288, 553, 701, 131

(56) References Cited

U.S. PATENT DOCUMENTS 5,184,960 A 2/1993 Hopkins et al. ..... 439/35
5,651,683 A * 7/1997 Shimamura et al. ..... 439/34
5,857,863 A * 1/1999 Onizuka et al. ..... 439/248
5,902,149 A 5/1999 Tashiro et al. ..... 439/557
5,941,731 A 8/1999 Kodama ..... 439/557
6,093,040 A * 7/2000 Kodama et al. ..... 439/157
6,165,009 A * 12/2000 Anbo et al. ..... 439/498

FOREIGN PATENT DOCUMENTS

EP 0 863 576 A1 9/1998

* cited by examiner

*Primary Examiner*—P. Austin Bradley
*Assistant Examiner*—Phuongchi Nguyen
(74) *Attorney, Agent, or Firm*—Oliff & Berridge, PLC

(57) ABSTRACT

An attachment structure of a connector is configured so that a group 40 of wires connected to a connector 20, in which a connector block 21 is supported by a holder 22 fixed to a stationary attachment member 31 in such a way as to be able to cause relative displacement with respect to a stationary attachment member 31, is nearly equally divided into divided groups at a rear portion of the connector block 21, and that each of the divided groups of wires 41 and 42 is fixed to a corresponding one of supports 32 and 33 for a stationary attachment member 31.

1 Claim, 4 Drawing Sheets

ATTACHMENT PORTION STRUCTURE OF CONNECTOR

BACKGROUND OF THE INVENTION

1. Field of the Invention

The present invention relates to an attachment portion structure of a connector, in which a connector block having a plurality of terminals arranged therein is supported by a holder fixed to a stationary member in such a way as to be able to cause relative displacement with respect to the stationary member.

2. Description of the Related Art

In recent years, there has been developed an apparatus in which a plurality of electronic devices to be installed on an instrumental panel of a vehicle as standard are modulated as an electronic module unit.

For example, an electronic module unit 100 shown in FIG. 3 has a structure adapted so that this module unit is fitted to a central recess portion of an instrumental panel from the front thereof. A panel side integrated connector 70 is provided on an attachment plate 81 placed in the front of an instrumental panel side, while a module side connector 101 to be connected to a panel side integrated connector 70 is fixed onto a lower part of an attachment surface 100*b* at the side of the rear surface of the electronic module unit 100.

When this electronic module unit 100 is attached by being fitted into a central recess portion of the instrumental panel from the front thereof, the module side connector 101 is connected to a panel side integrated connector 70, so that each of electronic devices is electrically connected to an instrumental panel side circuit.

This connector 70 has an oblong connector block 71, in which a plurality of terminals are arranged, as illustrated in FIG. 3. A group 73 of wires respectively connected to the terminals 70 is rearwardly led out of this connector block 71. Further, this connector 70 has a housing portion 72*a* for accommodating the connector block 71. This housing portion 72*a* is supported by a holder 72 fixed to an attachment plate 81 in such a way as to be able to cause relative displacement with respect to the stationary attachment plate 81.

Incidentally, as shown in, for example, FIG. 4, a wire harness 73*a,* which includes wires for a power supply system, for a signal system, for a camera image, and for controlling a heater, and antenna wires 73*b* for a television set, for a radio set, and for GPS, and a wire harness 73*c* for retrofitted optional equipment are collectively connected to the panel side integrated connector 70.

In case of the conventional connection structure of a connector, all the wires 73 to be connected to the connector 70 are bundled and led out in a single direction. Thus, a force biased in a direction, in which the wires are led out, is acted on the connector block 71, so that the connector block 71 is put into a tilted state. Consequently, the connector block 71 cannot be held in normal connection standby position and attitude. This may impede the connection between both the connectors 70 and 101.

SUMMARY OF THE INVENTION

The invention has been made to solve the problems with the related art, and therefore n object of the invention is to provide an attachment portion structure of a connector, which is enabled to hold a connector block in normal connection position and attitude, thereby to smoothly and reliably perform the connection between connectors.

According to the invention, there is provided an attachment portion structure of a connector having a connector block, in which a plurality of terminals are arranged in a predetermined direction, supported by a holder fixed to a stationary member in such a way as to be able to cause relative displacement with respect to the stationary member. A group of wires connected to the connector is nearly equally divided into divided groups, which are respectively led out to opposite directions, at a rear portion of the connector block, and that each of the divided groups of wires is fixed to the stationary member.

With the aforementioned configuration, a group of wires connected to the connector is nearly equally divided into divided groups, which are respectively led out to opposite directions, at a rear portion of the connector block, and that each of the divided groups of wires is fixed to the stationary member. Forces caused by drawing the groups of wires therearound are uniformly exerted in the opposite directions on the connector block supported on the holder, and thus cancel out. Thus, the connector block is held in the normal connection position and attitude without tilting the connector block. Consequently, the connection of the connectors can be smoothly reliably connected to each other.

DETAILED DESCRIPTION OF THE PREFERRED EMBODIMENTS

Hereinafter, an embodiment of the invention is concretely described with reference to the accompanying drawings.

Figure 1:
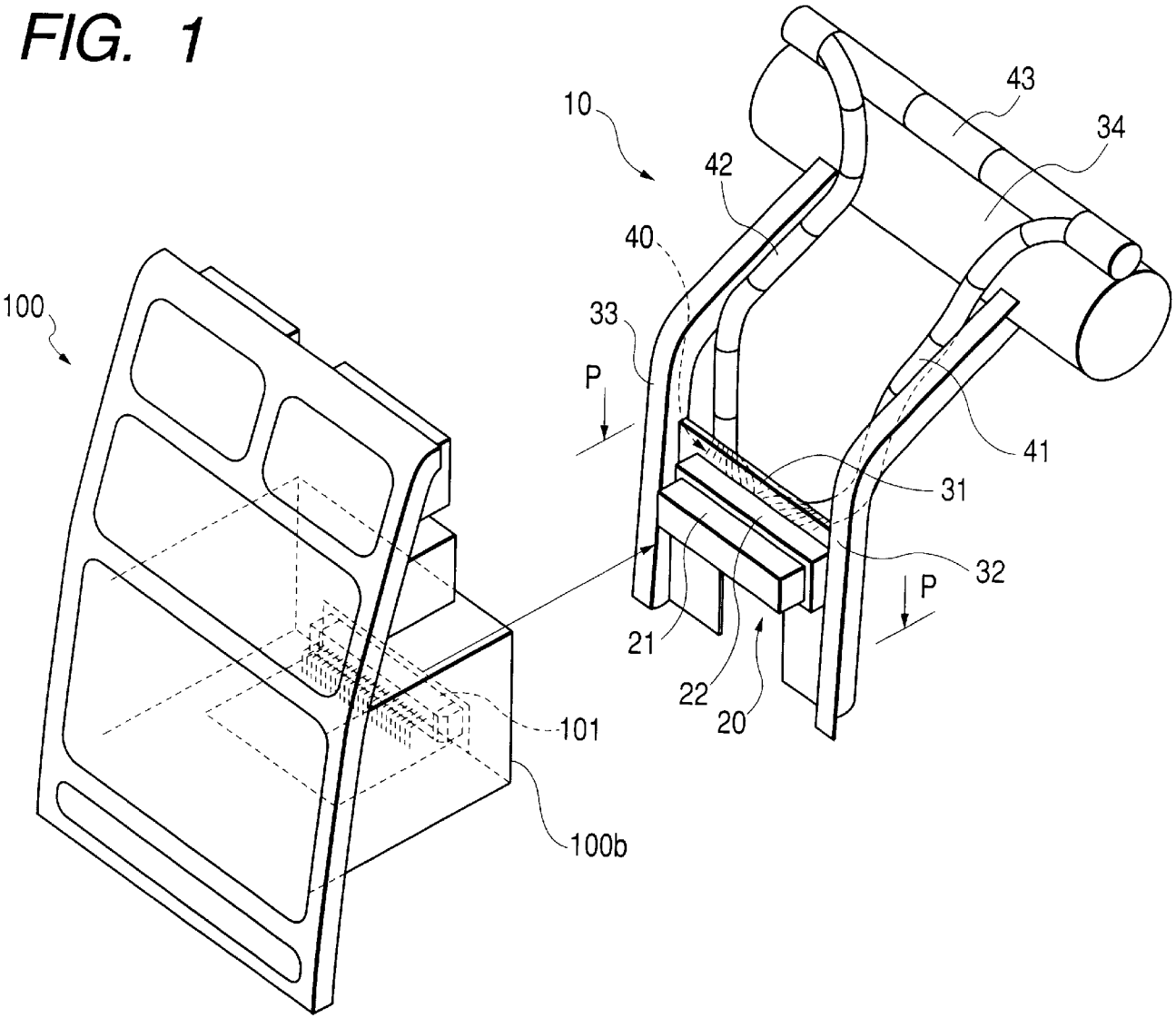
FIG. 1 is a perspective view illustrating the configuration of an example of an attachment portion structure of a connector according to the invention.
Figure 2A:
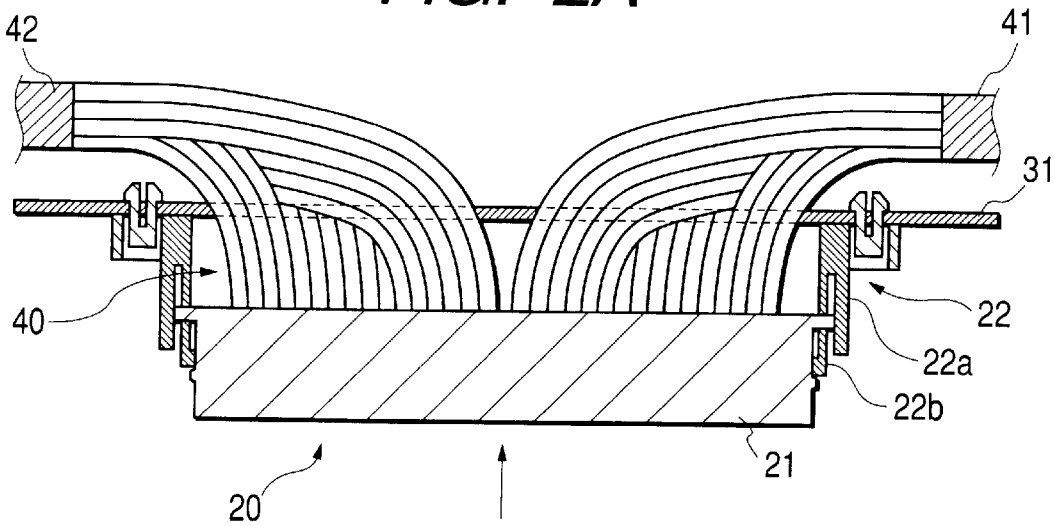
FIGS. 2A and 2B are sectional views each taken in the direction of arrows P—P of FIG. 1, and respectively illustrate a state, in which the connector block is in a connection standby position, and a state in which the connector block is in the connection position.
Figure 2B:
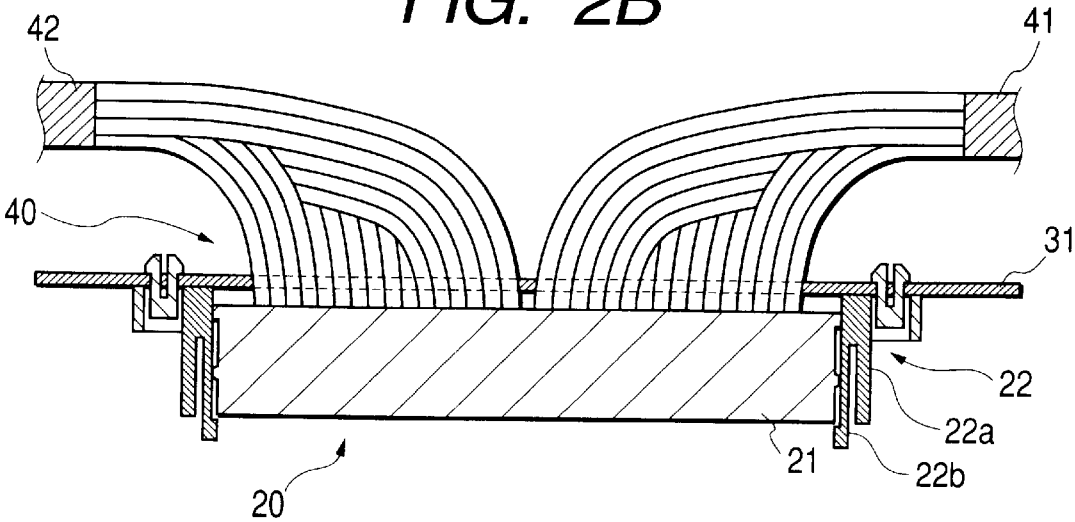
Figure 3:
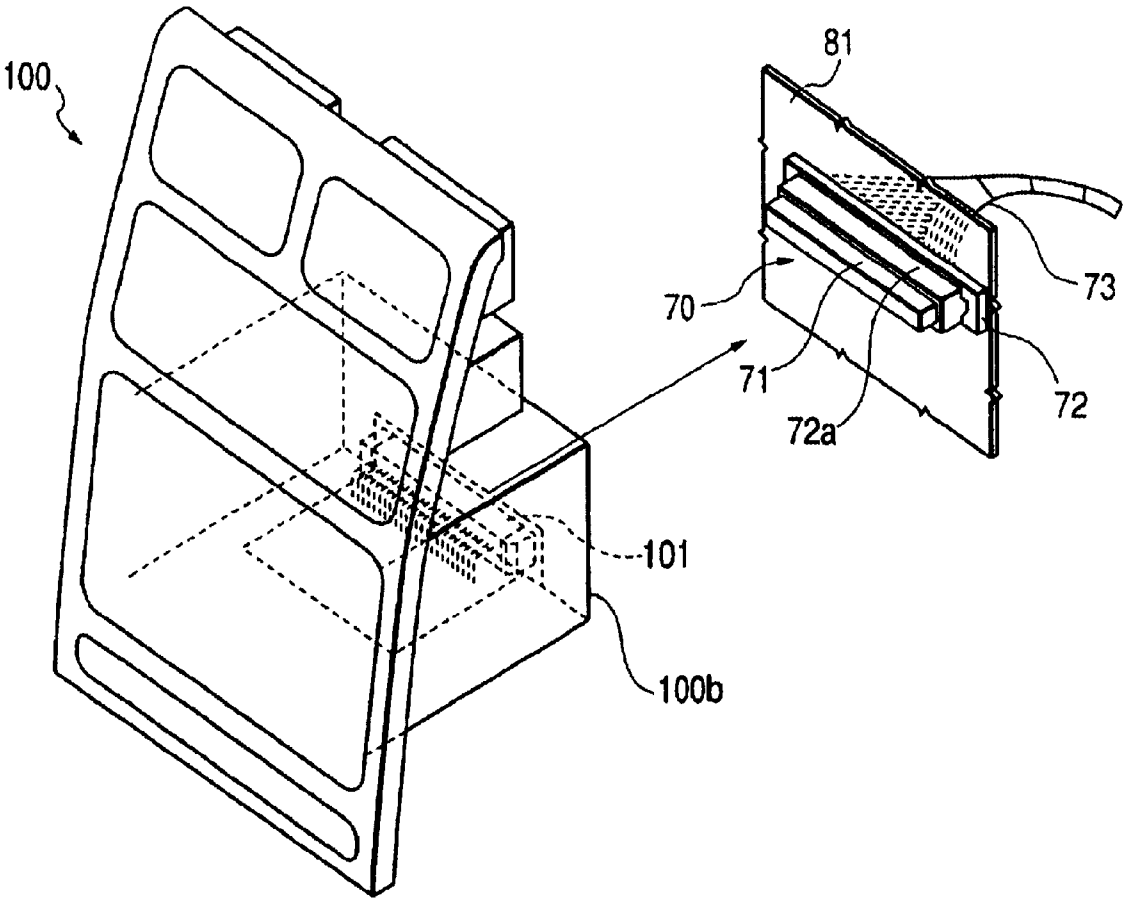
FIG. 3 (Prior Art)
FIG. 3 is a view illustrating the configuration of an example of a conventional attachment portion structure of a connector.
Figure 4:
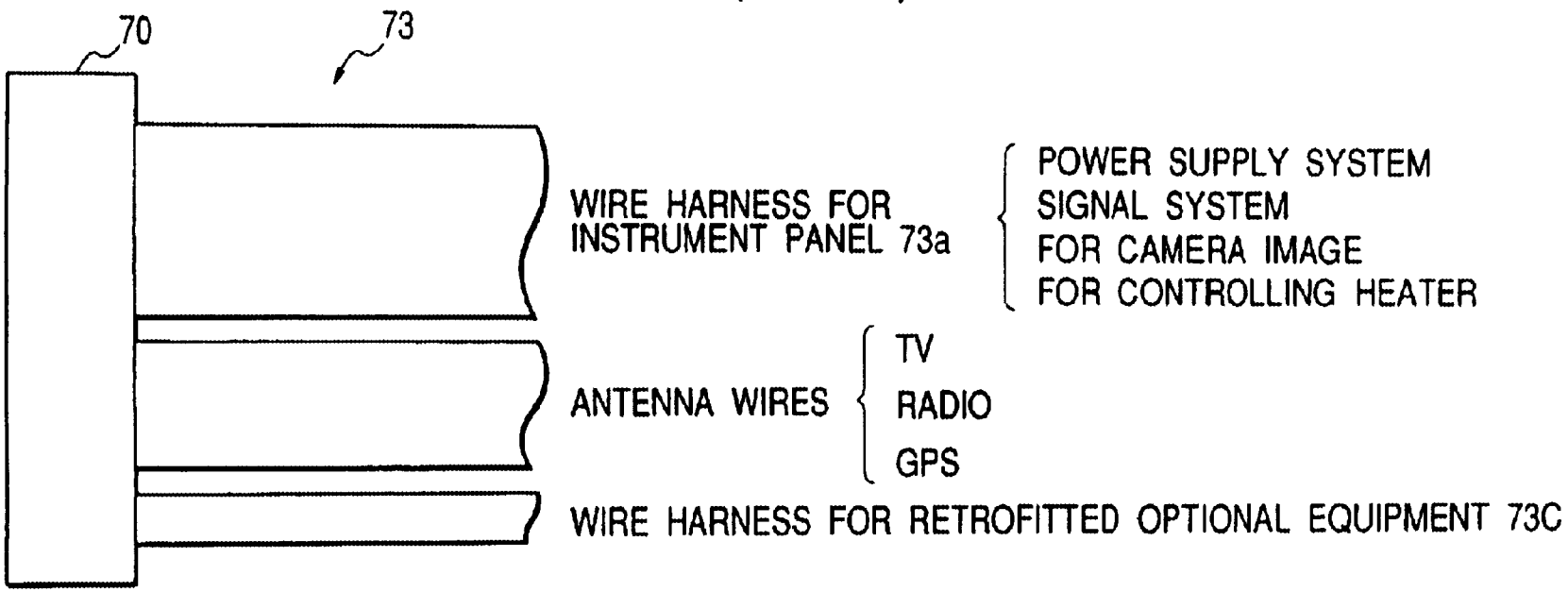
FIG. 4 (Prior Art)
FIG. 4 is an explanatory view illustrating wiring to be connected to an instrumental-panel-side integrated connector.

FIGS. 1, 2A, and 2B illustrate the configuration of an example of an attachment portion structure of a connector according to the invention.

An electronic module unit 100 has a structure adapted so that this module unit is fitted to a central recess portion of an instrumental panel from the front thereof. A panel side integrated connector 20 is provided on an attachment member 31 placed in the front of an instrumental panel side, while a module side connector 101 to be connected to a panel side integrated connector 70 is fixed onto a lower part of an attachment surface 100*b* at the side of the rear surface of the electronic module unit 100.

Meanwhile, at the side of a vehicle body, a pair of left-hand side and right-hand side supports 32 and 33 obliquely and downwardly extend from a wire fixing member 34 extending in the direction of width thereof. Both bottom portions of the supports 32 and 33 are connected by a horizontal attachment member 31 to each other. Further, the connector 20 is connected to this attachment member 31.

The connector 20 comprises a connector block 21, in which a plurality of terminals are arranged in a predetermined direction, and a holder 22 for supporting this connector block 21 and for fixing this block 21 to the stationary attachment member 31. The holder 22 has a housing portion 22*a* and lock arms 22*b* for tentatively locking the connector block 21 are provided in this housing portion 22*a*. Further, the connector block 21 is locked by the lock arms 22*b* of the holder 22, so that the connector block 21 is supported thereon in such a way as to be able to cause relative displacement with respect to the stationary attachment member 31.

In an attachment portion structure 10 of this connector 20, a group of wires 40 is almost equally divided into divided groups, which are respectively led out to opposite sides. Each of the divided groups 41 and 42 of wires is fixed in such a manner as to extend along a corresponding one of a V-shaped right-hand side support 32 and a V-shaped left-hand side support 33, and led to a wire fixing member 34 laterally extending in a front panel portion. Furthermore, the divided groups 41 and 42 of wires are led to a predetermined connection portion together with other wires 43 provided around a front panel. Then, such wires are connected to one another thereat.

According to this attachment portion structure 10, forces caused by drawing the groups 41 and 42 of wires therearound are uniformly exerted in the opposite directions on the connector block 21 supported on the holder 22, and thus cancel out. Consequently, the connector block 21 is held in normal connection position and attitude without tilting the connector block 21.

This prevents an extra load, which is other than a connection load, from being imposed on when an operation of connecting a counter-connector 101 to the connector 20 is performed. Thus, when the electronic module unit 100 is fitted from the front thereof into the central recess portion of the instrumental panel thereby to be attached thereto, the module side connector 101 is reliably connected to the panel side integrated connector 20. Thus, each of electronic devices is electrically connected to an instrumental panel side circuit.

More particularly, the connector block 21 is attached to the housing portion 22*a* so that the connection between the connector block 21 and the counter-connector 101 slides in a connection direction from a connection standby position shown in FIG. 2A to a connection position shown in FIG. 2B. Thus, these constituent elements constitute a connecting force amplifying mechanism for amplifying the connecting force acting between both the connectors 20 and 101 when an operation of connecting the counter-connector 101 to the connector 20 is performed.

Incidentally, the connection structure of the connector, which has this connecting force amplifying mechanism, is well known. The invention can be applied to a connector disclosed in, for example, JP-A-10-21992. Further, the mechanism for supporting the connector block in such a way as to be able to cause relative displacement with respect to a stationary member is well known. The invention can be applied to the connector disclosed in, for instance, JP-A-10-134900.

In the case that the connection mechanism of a connector according to the invention is employed in the connector having such a connection amplifying mechanism, the connector block is held in the normal connection standby position and attitude. This prevents an extra load other than the connection load from being applied to the connector when an operation of connecting the connector to the counter-connector is performed. Consequently, the connectors can be smoothly connected to each other by reliably increasing the connecting force between both the connectors in response to a sliding operation of the connector block.

In spite of the foregoing description, the attachment portion structure of the connector according to the invention is not limited to the aforementioned concrete configuration of the embodiment. Needless to say, the attachment portion structure of the connector may be suitably changed by modifying, adding or deleting constituent elements if necessary.

As described above, in accordance with the attachment portion structure according to the invention, the group of wires of the connector is nearly equally divided at a rear portion of the connector block into divided groups that are then led out to opposite sides, respectively. Each of the divided groups of wires is fixed to the corresponding stationary member. Forces caused by drawing the divided groups of wires therearound are uniformly exerted in the opposite directions on the connector block supported on the holder, and thus cancel out. Thus, the connector block is held in the normal connection position and attitude without tilting the connector block. Consequently, the connection of the connectors can be smoothly and reliably connected to each other.

What is claimed is:

1. An attachment portion structure of a connector, comprising a connector block having a plurality of terminals arranged in a predetermined direction, the connector block supported by a holder that is directly fixed to a stationary member, the holder including a housing portion and locking arms which are unitarily formed, the holder extending from the stationary member such that the locking arms lock the connector block and cause relative displacement with respect to the stationary member, wherein a group of wires connected to said connector is nearly equally divided into divided groups, which are respectively led out to opposite directions, at a rear portion of said connector block, and wherein each of said divided groups of wires is fixed to said stationary member.

* * * * *